United States Patent [19]

Gilbert

[11] 4,128,614

[45] Dec. 5, 1978

[54] HALOGENATED AROMATIC POLYESTER FIBERS PREPARED VIA DRY-SPINNING HAVING REDUCED SPIN-LINE STATIC GENERATION

[75] Inventor: William C. Gilbert, Fairfield, Conn.

[73] Assignee: Celanese Corporation, New York, N.Y.

[21] Appl. No.: 798,973

[22] Filed: May 20, 1977

[51] Int. Cl.[2] ..... D01F 6/00

[52] U.S. Cl. ..... 264/205; 264/211

[58] Field of Search ..... 264/204, 205, 211; 260/47 C, 33.8 R, 61, 45.95

[56] References Cited

U.S. PATENT DOCUMENTS

| | | | |
|---|---|---|---|
| 3,669,927 | 6/1972 | Terasaki et al. | 260/47 C |
| 3,864,448 | 2/1975 | Stackman et al. | 264/205 |

*Primary Examiner*—Jay H. Woo

*Attorney, Agent, or Firm*—Robert J. Blanke

[57] ABSTRACT

Certain halogenated aromatic polyester fibers having reduced spin-line static generation when prepared via dry-spinning from a methylene chloride containing solution are provided by admixing an esterified hindered phenol prior to dry-spinning. A preferred esterified hindered phenol which may be utilized to reduce spin-line static is tetrakis[methylene 3-(3′,5′-di-t-butyl-4-hydroxyphenyl) propionate] methane.

13 Claims, No Drawings

HALOGENATED AROMATIC POLYESTER FIBERS PREPARED VIA DRY-SPINNING HAVING REDUCED SPIN-LINE STATIC GENERATION

BACKGROUND OF THE INVENTION

Dry-spinning of halogenated aromatic polyesters (i.e., spinning of a solution of the polymer into an atmosphere evaporative for the solvent) is a well-known method for forming shaped articles such as fibers of the polymeric material.

In a typical commercial dry-spinning operation, a polymer containing solution is dry-spun by extruding the solution through a plurality of openings or jets into a spinning column where the solvent is evaporated. During the extrusion process, a static charge, or spin-line static may tend to build up on the extruded fibers. Under certain extrusion conditions a streaming potential E is developed at the spinneret which, in turn, generates a static charge on the extruded fibers sufficient to induce a phenomonon known as spraying. For example, a polyester of the type described herein when dissolved in 100% methylene chloride yields a solution which has a low specific conductance (λ). When this solution is dry-spun through a metal jet to form fibers in a typical dry-spinning operation electrons are either stripped from, or transferred to, the metal capillary walls by the liquid stream undergoing extrusion. This transfer of electrons develops what is referred to as streaming potential which in turn generates a static charge or spin-line static on the exit stream of fibers sufficient to cause spraying of the fibers. "Spraying" describes the behavior of the fibers at the jet in which they are mutually repelled by the static charges present thereon. The extent of the charge on the fibers during extrusion can be measured with an electrostatic voltmeter which is a relative measure of the streaming potential, E.

If the spin-line static charge is strong enough it will repel the fibers with a force sufficient to cause them to strike the wall of the metier cabinet (i.e., evaporating chamber) thereby interrupting the extrusion process.

It is known to add sterically hindered phenols to polyesters for color stabilization illustrated by U.S. Pat. Nos. 3,669,927; 3,285,855 and British Pat. No. 1,107,832.

It is therefore an object of the present invention to provide an improved process for dry-spinning certain halogenated aromatic polyesters to yield fibers having reduced spin-line static generation.

It is a further object of the present invention to provide a solution which is adaptable to form fibers via dry-spinning having reduced spin-line static generation.

It is a still further object of the present invention to provide a composition adaptable for use in a dry-spinning process utilized to prepare certain halogenated aromatic polyester fibers having reduced spin-line static generation.

These and other objects as well as the scope, nature and utilization of the invention will be apparent to those skilled in the art from the following description and appended claims.

SUMMARY OF THE INVENTION

In one aspect of the present invention there is provided a dry-spinning process for forming fibers of certain halogenated aromatic polyesters by extruding a solution of a halogenated aromatic polyester of the recurring structural formula:

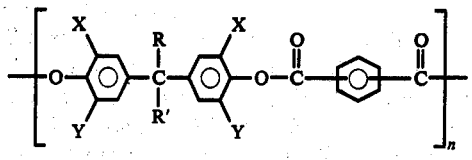

where X which may be the same or different is chlorine or bromine, Y which may be the same or different is hydrogen, chlorine or bromine, R and R′ may be the same or different and represent lower alkyl groups, hydrogen, or together constitute a cyclic hydrocarbon group, and n equals at least 25, while dissolved in methylene chloride, through an opening into an evaporative atmosphere for the methylene chloride; the improvement comprising incorporating an esterified hindered phenol having the structural formula:

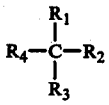

where $R_1$ is

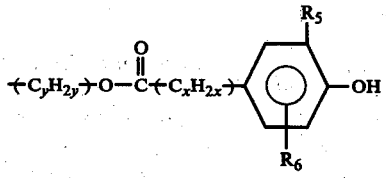

$R_2$ is

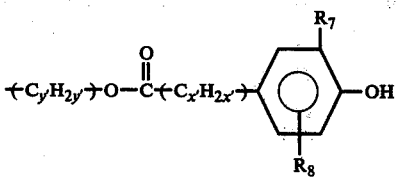

$R_3$ is

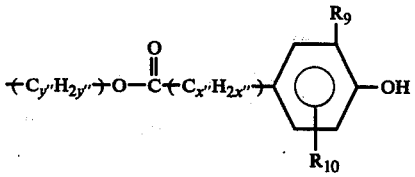

and $R_4$ is

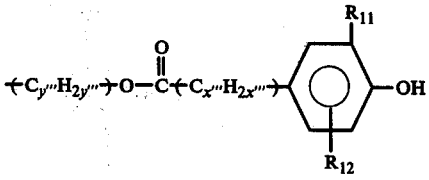

and where x; x', x'', x''', y, y', y'', y''' represents an integer which can vary from 1 to 6 and $R_5$, $R_6$, $R_7$, $R_8$, $R_9$, $R_{10}$, $R_{11}$ and $R_{12}$ which may be the same or different represent a straight or branched chain hydrocarbon having from 1 to 6 carbon atoms, into said solution in an amount of from about 0.1 to about 2.5% by weight based on the weight of said dissolved halogenated aromatic polyester which serves to reduce the generation of spin-line static during the extrusion process.

In another aspect of the present invention there is provided a solution having methylene chloride present therein adapted to form fibers via dry-spinning when extruded through an opening into an evaporative atmosphere for the methylene chloride which solution comprises:

I. a mixture of:

(a) from about 15 to about 30% by weight of the solution of a halogenated aromatic polyester of the recurring structural formula:

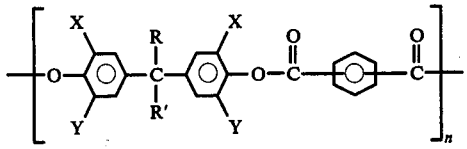

where X which may be the same or different is chlorine or bromine, Y which may be the same or different is hydrogen, chlorine or bromine, R and R' may be the same or different and represent lower alkyl groups, hydrogen, or together constitute a cyclic hydrocarbon group, and n equals at least 25, and (b) from about 0.1 to about 2.5% by weight of the polyester of an esterified hindered phenol having the structural formula:

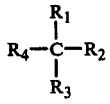

where $R_1$ is

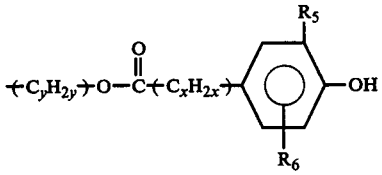

$R_2$ is

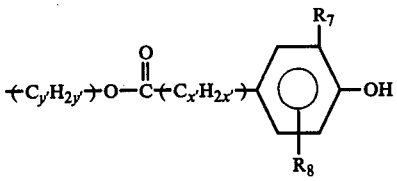

$R_3$ is

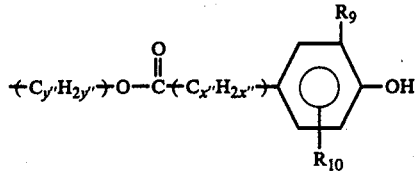

and $R_4$ is

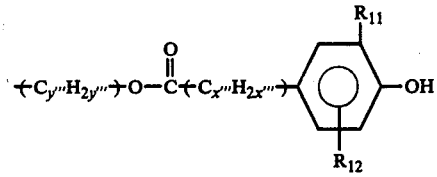

and where x, x', x'', x''', y, y', y'', y''' represent an integer which can vary from 1 to 6 and $R_5$, $R_6$, $R_7$, $R_8$, $R_9$, $R_{10}$, $R_{11}$ and $R_{12}$ which may be the same or different represent a straight or branched chain hydrocarbon having from 1 to about 6 carbon atoms, dissolved in:

II. from about 85 to about 70% by weight of the solution of methylene chloride, said solution yielding fibers having reduced spin-line static generation upon dry-spinning.

In a still further aspect of the present invention there is provided a composition adaptable for use in a dry-spinning process utilized to prepare certain aromatic polyester fibers by extruding a solution of said composition in methylene chloride through an opening into an evaporative atmosphere for the methylene chloride which comprises a physical blend in intimate admixture of:

I. a halogenated aromatic polyester of the recurring structural formula:

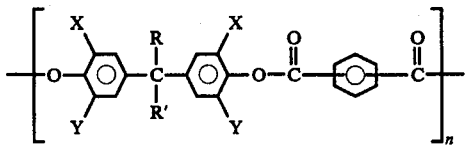

where X which may be the same or different is chlorine or bromine, Y which may be the same or different is hydrogen, chlorine or bromine, R and R' may be the same or different and represent lower alkyl groups, hydrogen, or together constitute a cyclic hydrocarbon group, and n equals at least 25, and II. from about 0.1 to about 2.5% by weight of the polyester of an esterified hindered phenol having the structural formula:

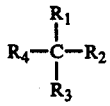

where $R_1$ is

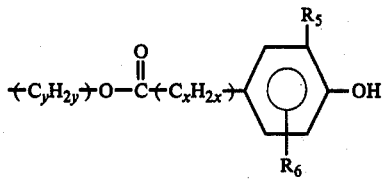

$R_2$ is

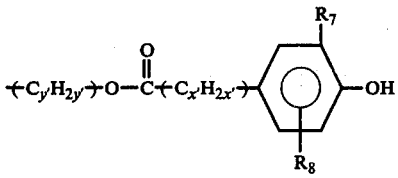

$R_3$ is

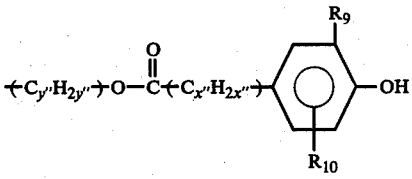

and $R_4$ is

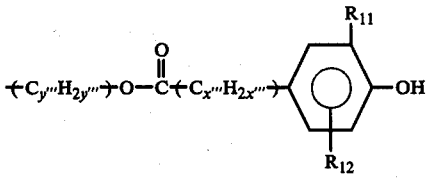

and where x, x', x'', x''', y, y', y'', y''' represent an integer which can vary from 1 to 6 and $R_5$, $R_6$, $R_7$, $R_8$, $R_9$, $R_{10}$, $R_{11}$ and $R_{12}$ which may be the same of different represent a straight or branched chain hydrocarbon having from 1 to about 6 carbon atoms, said composition being capable of yielding a fiber having reduced spin-line static generation upon dry spinning.

DESCRIPTION OF PREFERRED EMBODIMENTS

It has been found that the build up of a spin-line static charge on the dry-spun fibers can be substantially reduced or eliminated by utilizing an esterified hindered phenol in combination with certain halogenated aromatic polyesters herein described which combination is then extruded in accordance with a dry-spinning process to obtain a fibrous product.

The halogenated aromatic polyester which is dry-spun in accordance with the present invention has recurring units of the structural formula:

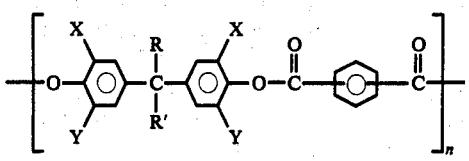

where X which may be the same or different is chlorine or bromine, Y which may be the same or different is hydrogen, chlorine or bromine, R and R' may be the same or different and represent lower alkyl groups (e.g., 1 to 5 carbon atoms), hydrogen, or together constitute a cyclic hydrocarbon group, and n = at least 25 (e.g., n = about 40 to 400). Commonly the aromatic polyester utilized in the present invention has a chlorine and/or bromine content of about 15 to 60% by weight based upon the weight of the aromatic polyester, e.g., a chlorine and/or bromine content of about 25 to 50% by weight. As is apparent from the structural formula, the aromatic polyester is chlorinated and/or brominated in the sense that these substituent groups are directly attached to an aromatic ring. Preferably the halogen substituents are either all chlorine or all bromine, and in a particularly preferred embodiment the halogen substituents are all bromine.

The end groups of the aromatic polyester illustrated in the formula commonly are — OH, or

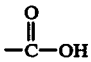

depending upon the synthesis route selected as will be apparent to those skilled in the art. Suitable methods for the manufacture of such aromatic polyesters are disclosed in U.S. Pat. Nos. 2,035,578; 3,234,167; and 3,824,213; Australian Pat. No. 242,803; and British Pat. No. 924,607; which are herein incorporated by reference. The brominated or chlorinated aromatic polyester may be formed by the condensation of tetrabromobisphenol A (i.e., 4,4'-isopropylidene-2,2',6,6'-tetrabromodiphenol) or tetrachlorobisphenol A (i.e., 4,4'-isopropylidene-2,2',6,6'-tetrachlorodiphenol) with isophthalic acid and/or terephthalic acid or the ester-forming derivatives thereof.

A preferred brominated aromatic polyester is formed by the condensation of tetrabromobisphenol A (i.e., 4,4'-isopropylidene-2,2',6,6'-tetrabromodiphenol) with an aromatic acid mixture of about 45 to 75% by weight (e.g., 60% by weight) isophthalic acid and correspondingly about 55 to 25% by weight (e.g., 40% by weight) terephthalic acid or the ester-forming derivatives thereof. For instance, tetrabromobisphenol A may be reacted with a mixture or isophthaloyl chloride and terephthaloyl chloride in the presence of an appropriate solvent and catalyst to produce a polymer having —OH and

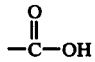

end groups. A preferred chlorinated aromatic polyester is formed by the condensation of tetrachlorobisphenol A (i.e., 4,4'-isopropylidene-2,2',6,6'-tetrachlorodiphenol) with an aromatic acid mixture of about 90 to 40% and most preferably from about 80 to 60% (e.g., 70%) by weight isophthalic acid and correspondingly about 10 to 60% and most preferably from about 20 to 40% (e.g., 30%) by weight terephthalic acid or the ester-forming derivatives thereof. For instance, a lower carboxylic acid diester of a monocarboxylic acid possessing 2 to 5 carbon atoms and tetrachlorobisphenol A may be reacted with a mixture of terephthalic acid and isophthalic acid in the presence of an appropriate solvent and catalyst.

The esterified hindered phenol which may be utilized in accordance with the present invention is represented by the structural formula:

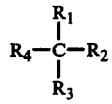

I.

where $R_1$ is

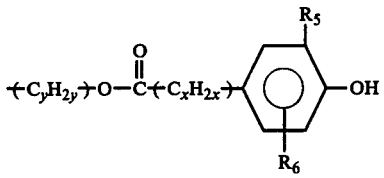

$R_2$ is

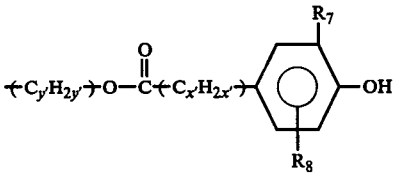

$R_3$ is

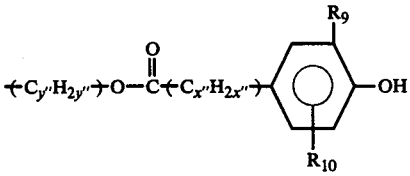

and $R_4$ is

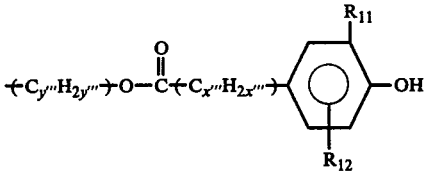

and where x; x', x'', x''', y, y', y'', y''' represent an integer which can vary from 1 to 6 and $R_5$, $R_6$, $R_7$, $R_8$, $R_9$, $R_{10}$, $R_{11}$ and $R_{12}$ which may be the same or different represent a straight or branched chain hydrocarbon having from 1 to about 6 carbon atoms.

The compounds represented by formula I are polyesters of alkanepolyols wherein the ester group comprises the acyl moiety

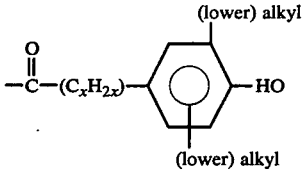

II.

in which x has a value of from 1 to 6, preferably from 1 to 5, and most preferably from 1 to 3 (e.g., 2). The term lower alkyl includes a branched or straight chain hydrocarbon of from 1 to about 6 carbon atoms and represents R groups 5 through 12 of structural formula I inclusively.

Representative of such lower aklyl groups are methyl, ethyl, propyl, butyl and preferably branched groups such as $\tau$ -butyl.

It will be observed that the di (lower) alkylphenol and embodiments thereof exhibit at least one (lower)alkyl group in a position ortho to the hydroxy group. The other (lower)alkyl group is either (a) in the other position ortho to the hydroxy group or (b) meta to the hydroxy group and para to the first (lower)alkyl group. It is preferred that both lower alkyl groups be located in the ortho position.

The alkane polyols from which the compounds of formula I are prepared can be represented as follows:

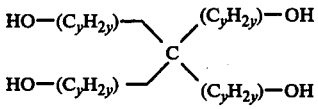

wherein y is an integer which can vary from 1 to 6, preferably from 1 to 5, and most preferably from 1 to 3 (e.g., 1).

Representative of such polyols are 3,3-diethyl pentanetetrol, 4,4-d,dipropylheptanetetrol; 5,5-dibutylnonanetetrol and preferably 2,2-dimethylpropanetetrol.

The preferred esterified hindered phenol is tetrakis [methylene 3-(3',5'-di-t-butyl-4'-hydroxyphenyl) propionate] methane which is commercially available from Ciba-Geigy under the tradename IRGANOX 1010 TM.

The esterified hindered phenolic compounds utilized in the present invention may be prepared in accordance with U.S. Pat. Nos. 3,285,855 and 3,330,859 which are herein incorporated by reference.

Thus, said compounds may be prepared via standard esterification procedure from a suitable alcohol and acid of the formula

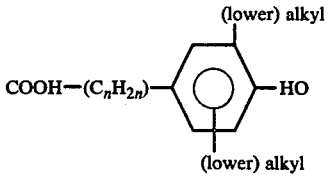

IV.

where n represents an integer of from 1 to 6, or an acid halide, acid anhydride or mixed anhydride thereof.

Similarly the novel esters used in this invention may be prepared by conventional methods of esterification or of transesterification and preferably are prepared from the partial alkanoic acid esters of the particular polyol by further partial or complete esterification with an acid of the above formula or a reactive derivative thereof such as its acid chloride or anhydride. Alternatively a glycol partially esterified by the acyl moiety may be further esterified by alkanoic acid or derivative thereof.

Preparation of the methylene chloride containing solution of the present invention adapted to form fibers via dry-spinning may be accomplished by (1) adding a mixture of (a) from about 15 to about 30%, preferably from about 15 about 25%, and most preferably from about 18 to about 22% by weight of the resulting polymer containing solution, of a halogenated aromatic polyester of the above-described formula and (b) an effective amount of the esterified hindered phenol described herein, to (2) methylene chloride which is present in an amount sufficient to dissolve the halogenated aromatic polyester and to yield a solution capable of being dry-spun. Although the esterified hindered phenol is present with the halogenated aromatic polyester in said mixture in any effective amount sufficient to reduce spin-line static it is preferred that such amount constitute from about 0.1 to about 2.5%, preferably from about 0.25 to about 2%, and most preferably from about 0.25 to about 1% (e.g., 0.5%) by weight of the polyester.

The amount of methylene chloride which is utilized to prepare the dry-spinning solution will generally constitute from about 85 to about 70%, preferably from about 85 to about 75%, and most preferably from about 82 to about 78% by weight of the total solution of methylene chloride and said mixture. The combination of the components of said mixture may be accomplished by mixing the halogenated aromatic polyester and the hindered phenol in any manner known to those skilled in the art prior to adding either component to the methylene chloride solvent. Alternatively and preferably, each component may be dissolved separately in said solvent.

Under the conditions employed in dry-spinning the hindered phenol does not react with the halogenated aromatic polyester.

Additional ingredients may optionally be added to the polymer containing solution such as flame retardants including a minor amount of an oxide of antimony, e.g., antimony trioxide ($Sb_2O_3$) or antimony pentoxide ($Sb_2O_5$), or other flame retardant additive. Other optional ingredients, which may be added to the solution include, U. V. stabilizers such as benzotriazoles.

Spinning of the solution may be performed using any suitable dry-spinning apparatus. Both downdraft and updraft spinning columns may be used under either heated or cooled column conditions. A typical spinning column can be about 6 inches in diameter and about 6 to 28 feet long.

Preferably the spinneret may be provided with a jet having multiple openings (e.g., up to about 40 holes or more) although a single opening may be satisfactory. Each opening is generally of the same size and often is in the range of from about 30 to about 76 microns. Typical spinneret jet openings, for example, may be 36, 42, 50 or 64 microns.

The temperature of the solution in the spinneret can vary from about 50° to about 85° C., and preferably from about 80° to about 85° C. The temperature of the inert gas (e.g., air) at the top of the column can vary from about 25° to about 85° C. and preferably from about 60° to about 75° C. while the temperature of the inert gas at the bottom of the column can vary from about 40° to about 80° C., and preferably from about 50° to about 60° C.

The fiber produced in the spinneret can have a denier generally in the range of from about 6 to about 64, preferably from about 8 to about 12, denier per fiber (dpf). The as-spun fibers are typically drawn four to six times in length (to about one-fourth to one-sixth of original dpf after drawing), with, for example, a drawing ratio of from about 4:1 to about 5:1 ot more (e.g., up to about 8:1) over a heated shoe at a temperature of from about 300° to 345° C. (e.g., 325° C.) in accordance with known techniques.

It should be noted that as the fibers are extruded a limited amount of spraying, with an increase in fiber bundle diameter, can be tolerated. If the fiber bundle diameter becomes too large, fibers will hit the cabinet walls, resulting in end breaks.

It is known that for a constant repelling force on the fibers the diameter of the fiber bundle increases with an increase in the distance between the jet and the looping bar, i.e., the exit point from spinning cabinet. The diameter of the filament bundle is a maximum midway between the jet and the looping bar. This maximum diameter is directly proportional to several process parameters including the charge on the individual fibers, and the pressure drop across the jet capillaries, and an increase in any of these parameters is accompanied by a corresponding increase in the maximum diameter.

As mentioned above, the passage of the polymer containing solution through the capillaries of the spinneret gives rise to an electrokinetic effect called a streaming potential. The streaming potential is a function of several variables and is described by the following equation:

$$\text{Streaming Potential, } E = \frac{\zeta E P}{4\pi\eta\lambda}$$

where:

$\zeta$ = "zeta" or electrokinetic potential
$\epsilon$ = dielectric constant of the solution
$\rho$ = pressure drop across the capillary
$\eta$ = viscosity of the solution
$\lambda$ = specific conductance of the liquid solution For a more detailed description of streaming potential see H. S. Taylor and S. Glasstone, *A Treatise on Physical Chemistry,* 631 (3rd ed. 1951) which is herein incorporated by reference.

The direct determination of the streaming potential, however, is a very sophisticated procedure in colloid and surface chemistry and for practical purposes is difficult to measure.

It has been observed, however, that the streaming potential, which characterizes the transfer of electrons which occurs at the spinneret, generates a static charge on the extruded fibers which is directly proportional to the streaming potential. Consequently, the magnitude of the streaming potential, E, and indirectly the static charge both are functions of the parameters of the above equation describing the streaming potential. For example, the static charge is directly proportional to the pressure drop across the jet capillaries, i.e., inversely proportional to the diameter of the capillaries and directly proportional to the extrusion rate of the fibers. It is, therefore, possible to relate the behavior of the extruded fibers in terms of their potential to exhibit a spraying effect to the easily measurable parameter of static charge, i.e., spin-line static.

The static charge developed on the fibers during extrusion as a result of the streaming potential at the jet can be measured with an electrostatic voltmeter such as model CS-66 electrostatic voltmeter produced by Custom Scientific Instruments, Inc. by positioning the probe of the instrument about one-half inch from the moving fibers where they exit from the spinning cabinet.

In the absence of the esterified hindered phenol described herein the static charge developed on a twenty filament yarn from the described halogenated aromatic polyester in the dry-spinning process may vary from +25 to +200 volts depending on the diameter of the spinneret capillaries, extrusion speed, viscosity of the extrusion solution, etc.

The esterified hindered phenol described herein when utilized in a dry-spinning process in combination with the halogenated aromatic polyester also described herein will yield fibers having a spin-line static charge of less than about 5 volts, preferably less than about 3 volts and most preferably less than about 1 volt (e.g., 0 volt).

The resulting halogenated aromatic polyester fibers having the hindered phenol impregnated therein can be provided in a variety of physical configurations such as fluff, sliver, yarns, tows, rovings, fibrids, filaments, etc., and may consist of staple or continuous fibers and they may be utilized in both textile and non-textile applications. For instance, carpets, textiles, wall coverings, hospital cubicle draperies, children's sleepwear, flight suits, slippers, upholstery, thread, apparel, etc., may be formed from the same.

The following example is given as a specific illustration of the claimed invention. It should be understood, however, that the invention is not limited to the specific details set forth in the example. All parts and percentages in the examples as well as the remainder of the specification are by weight unless stated otherwise.

EXAMPLE I

Preparation of the polyester

A brominated aromatic polyester containing bromine chemically bound to an aromatic ring is prepared.

More specifically, the brominated aromatic polyester is formed by reacting 201.7 parts by weight tetrabromobisphenol A and a mixture of 46 parts by weight isophthaloyl chloride and 30.8 parts by weight terephthaloyl chloride. The resulting brominated aromatic polyester possesses the structural Formula heretofore illustrated where X and Y are bromine, R and R' are methyl groups, and n = about 50. The brominated aromatic polyester has a bromine content of about 48 percent by weight, and exhibits an inherent viscosity of about 0.75 deciliters per gram determined at a concentration of 0.1 percent by weight in a solvent which is a mixture of 10 parts by weight of phenol and 7 parts by weight trichlorophenol.

Preparation of Esterified Hindered Phenol

Tetrakis [methylene 3-(3', 5'-di-t-butyl-4'-hydroxyphenyl) propionate] methane is prepared as described in U.S. Pat. No. 3,330,859.

Dry-Spinning

The solution containing the brominated aromatic polyester is then prepared. Thus, 100 parts by weight of tetrabromobisphenol A is mixed with 0.5 parts by weight of tetrakis[methylene 3-(3', 5'-di-butyl-4'-hydroxyphenyl) propionate]methane previously prepared and the mixture is added to 372 parts by weight methylene chloride.

The solution is then separately dry-spun into fibers under the conditions shown below in Table I.

The spin-line static or static charge developed on the fibers is measured by an electrostatic voltmeter by positioning the probe of the instrument about one-half inch from the moving fibers where they exit from the spinning cabinet. The resulting spin-line static charge is also shown below in Table I.

Table I

| Solution Run No. | I |
|---|---|
| Dope Solids, % polyester and phenol by weight of solution | 21.3 |
| Dope Viscosity, Poise | 1600 |
| Jet (No. of Holes, hole size μ) | 10/42 |
| Jet Face Temperature, ° C | 80 |
| Column Temperature, ° C, Top | 60 |
| Column Temperature, ° C Bottom | 50 |
| Take-Up meters/min. | 100 |
| Column Length, feet | 25 |
| Column Air | Down draft |

The spin-line static charge is then determined and found to be 0 volts.

Comparative Example

The same procedure of example I is repeated except that the esterified hindered phenol is omitted. The spin-line static charge is found to be +45 volts for the brominated aromatic polyester.

As may be seen from the test results, the esterified hindered phenol substantially reduces the generation of spin-line static charge of the fibers into which it is incorporated during the dry-spinning process.

Although the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. In a dry-spinning process for forming fibers of certain halogenated aromatic polyesters by extruding a solution of a halogenated aromatic polyester of the recurring structural formula:

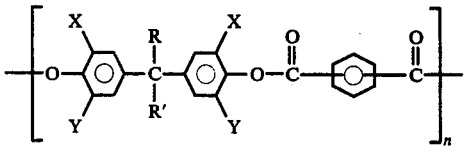

where X which may be the same or different is chlorine or bromine, Y which may be the same or different is hydrogen, chlorine or bromine, R and R' may be the same or different and represent lower alkyl groups, hydrogen, or together constitute a cyclic hydrocarbon group, and n equals at least 25, while dissolved in methylene chloride, through an opening into an evaporative atmosphere for the methylene chloride; the improvement comprising incorporating an esterified hindered phenol having the structural formula:

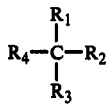

where $R_1$ is

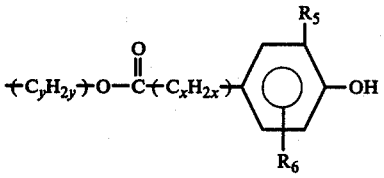

$R_2$ is

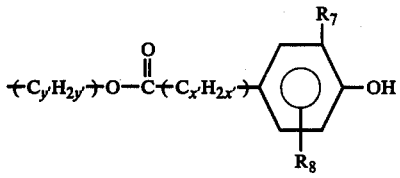

$R_3$ is

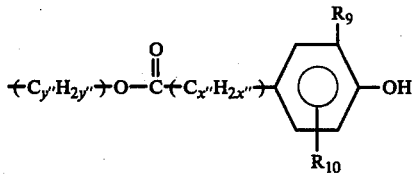

and $R_4$ is

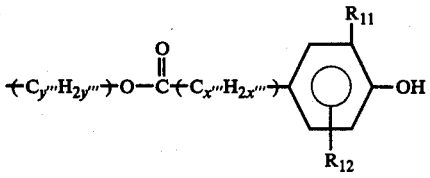

and where x, x', x'', x''', y, y', y'', y''' represent an integer which can vary from 1 to 6 and $R_5$, $R_6$, $R_7$, $R_8$, $R_9$, $R_{10}$, $R_{11}$ and $R_{12}$ which may be the same or different represent a straight or branched chain hydrocarbon having from 1 to 6 carbon atoms, into said solution in an amount of from about 0.1 to about 2.5% by weight based on the weight of said dissolved halogenated aromatic polyester which serves to reduce the generation of spin-line static during the extrusion process.

2. The process according to claim 1 wherein said halogenated aromatic polyester of the recurring structural formula is a product of tetrabromobisphenol A and a mixture of about 45 to 75% by weight isophthaloyl chloride and correspondingly about 55 to about 25% by weight terephthaloyl chloride.

3. The process according to claim 1 wherein said halogenated aromatic polyester of the recurring structural formula is a product of tetrabromobisphenol A and a mixture of about 60% by weight isophthaloyl chloride and correspondingly about 40% by weight terephthaloyl chloride.

4. The process according to claim 1 wherein said halogenated aromatic polyester of the recurring structural formula is a product of tetrachlorobisphenol A and a mixture of about 90 to 40% by weight isophthaloyl chloride and correspondingly about 10 to 60% by weight terephthaloyl chloride.

5. The process according to claim 1 wherein said halogenated aromatic polyester of the recurring structural formula is a product of tetrachlorobisphenol A and a mixture of about 70% by weight isophthaloyl chloride and correspondingly about 30% by weight terephthaloyl chloride.

6. The process of claim 1 wherein said solution is dry-spun through a multi-hole spinning jet in which each hole has a diameter of about 30 to about 76 microns into a spinning column.

7. The process of claim 1 wherein the hindered phenol is present in an amount which can vary from about 0.25 to about 2% by weight.

8. The process of claim 1 wherein the hindered phenol is present in an amount which can vary from about 0.25 to about 1% by weight based upon the weight of said dissolved halogenated aromatic polyester.

9. The process of claim 1 wherein the hindered phenol is tetrakis[methylene 3-(3', 5'-di-t-butyl-4'-hydroxyphenyl) propionate] methane.

10. The process of claim 9 wherein the hindered phenol is present in an amount of about 0.5% by weight of said dissolved halogenated aromatic polyester.

11. The process of claim 10 wherein the spin-line static on the extruded fibers is reduced to 0.

12. The process of claim 1 wherein R groups 6, 8, 10 and 12 of the esterified hindered phenol are in the ortho position with respect to the hydroxyl group and x, x', x'', x''', y, y', y'', y''' represent an integer which can vary from 1 to 3.

13. The process, according to claim 1 wherein said halogenated aromatic polyester and said esterified hindered phenol are dissolved separately in said methylene chloride to form said solution.

* * * * *